United States Patent [19]

Godfrey

[11] 4,153,322

[45] May 8, 1979

[54] KEYHOLE GROUNDING CLAMP

[75] Inventor: Edmund A. Godfrey, Scarborough, Canada

[73] Assignee: A. B. Chance Company, Centralia, Mo.

[21] Appl. No.: 831,339

[22] Filed: Sep. 7, 1977

[51] Int. Cl.[2] ..... H01R 7/08; H01R 3/06

[52] U.S. Cl. ..... 339/95 R; 339/14 L; 339/272 R

[58] Field of Search ..... 339/14 L, 95 D, 95 R, 339/237, 241, 263 R, 263 L, 272 R

[56] References Cited

U.S. PATENT DOCUMENTS

| | | | |
|---|---|---|---|
| 1,679,677 | 8/1928 | Milne | 339/14 L |
| 1,728,868 | 9/1929 | Pierce | 339/237 |
| 1,821,486 | 9/1931 | Taylor | 339/237 |
| 2,397,390 | 3/1946 | Wadsworth | 339/263 L |
| 2,841,774 | 7/1958 | Romanek | 339/272 R |

*Primary Examiner*—Joseph H. McGlynn

*Attorney, Agent, or Firm*—Schmidt, Johnson, Hovey & Williams

[57] ABSTRACT

A lightweight, grounding clamp assembly utilizes a grounding stud for rigid mounting on an electrical device and incorporates nondeformable, stud-engaging bight which renders the assembly capable of safely conducting extremely high fault currents in the order of 100,000 amps or more. The bight forms a part of an open-ended passage extending through the clamp body which passage is completely encircled by the body to resist distortion of the bight under the influence of high fault currents. In preferred embodiments, the passage has a keyhole-shaped cross-section and the stud is configured to be complementally received and retained within the neck of the keyhole.

3 Claims, 4 Drawing Figures

KEYHOLE GROUNDING CLAMP

This invention relates to grounding equipment in general and particularly concerns improved high fault current-rated grounding clamps intended for use in providing a safety ground for high voltage stations equipment when the latter is deenergized for maintenance.

When servicing deenergized high voltage electrical transmission and distribution equipment, it is necessary to ground the latter in order that maintenance workmen be protected against fault currents or inadvertent energizing of the equipment. Conventional grounding equipment for this purpose typically employs a grounding cable and a quick release clamp for removably coupling the cable to the electrical equipment.

While many types of grounding clamps are known in the art, heavy duty high fault current-rated clamps are almost universally of the C-type resembling in many respects the basic mehcanical C-clamp. Presently, these heavy duty clamps have a maximum fault current rating of 40,000 to 70,000 amps for 15 cycles. Beyond such fault currents, the extreme heat and tremendous electromagnetic forces produced by the high amperage combine to cause deflection of the C-clamped body such that its grip on the conductor is loosened, ultimately resulting in a failure of the clamp.

This problem is magnified by virtue of the fact that the clamps must be relatively lightweight to enable their installation and removal with conventional hot line tools. Consequently, higher fault current ratings for such clamps cannot be obtained by simply making larger and larger C-clamps inasmuch as weight becomes a critical factor. Thus, grounding clamps of known design are limited to a maximum rating of around 70,000 amps as mentioned hereinabove. However, with the increased fault currents now available in electrical transmission and distribution systems, it is desirable from a safety standpoint to provide a grounding system having as high a fault current rating as possible, yet still being easily installed and removed.

Accordingly, it is an important object of the present invention to provide a lightweight grounding clamp assembly having an increased fault current rating over grounding clamps known in the art.

In accordance with the foregoing objects, it is a further important object of the instant invention to provide a grounding clamp having a nondeformable body, thereby overcoming the problem of clamp release incident to deformation caused by extremely high fault currents.

It is yet another important object of my invention to provide a grounding clamp having a keyhole-shaped passage formed therein adapted to complementally receive a grounding stud to form a positive, yet easily released, coupling between the grounding clamp and the electrical device. In the drawing.

Figure 1:
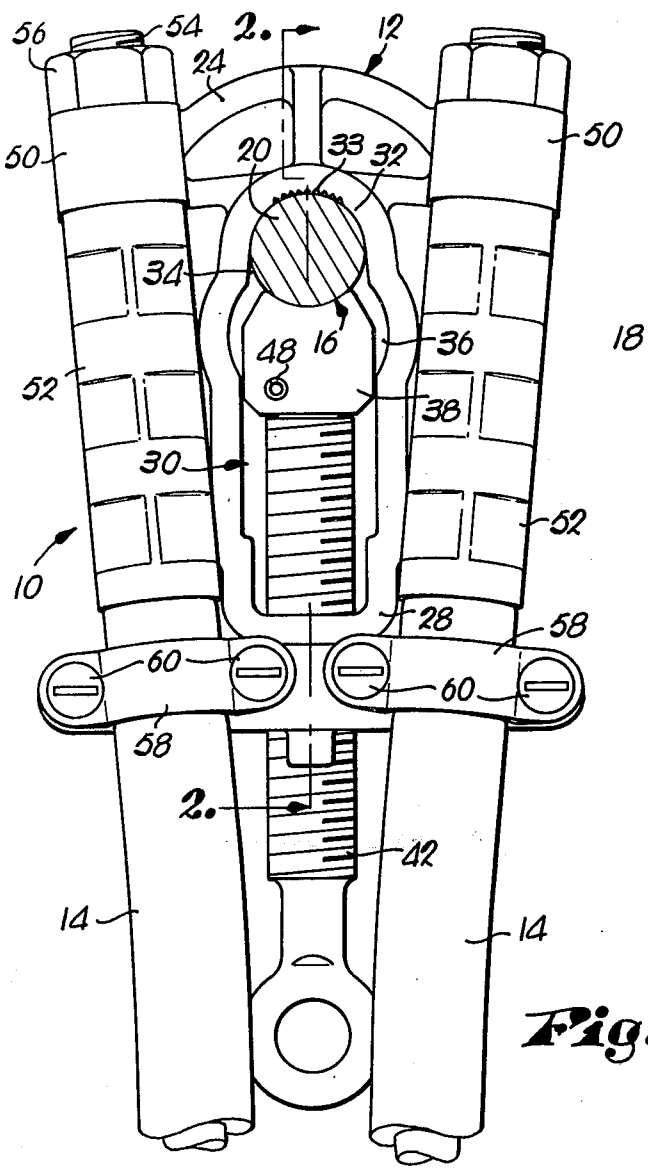
FIG. 1 is an elevational view of one side of a keyhole clamp constructed in accordance with the principles of my invention and showing the grounding stud in cross-section.

As shown in FIG. 1, a grounding clamp assembly 10 includes a grounding clamp 12 supporting a pair of ground cables 14, and a grounding stud 16 releasably engageable with the clamp 12.

The stud 16 comprises a flat base plate 18 adapted for mounting on an electrical device (not shown), an elongate, cylindrical shank 20 extending generally perpendicularly from the plate 18, and an enlarged annular shoulder 22 rigidly secured on the end of shank 20 remote from plate 18 and of a diameter greater than the shank 20.

The clamp 12 includes a body 24 of ribbed construction having a generally annular configuration and presenting a pair of opposed faces 26 and 28. Body 24 defines a central open-ended passage 30 extending therethrough between faces 26, 28.

Figure 3:
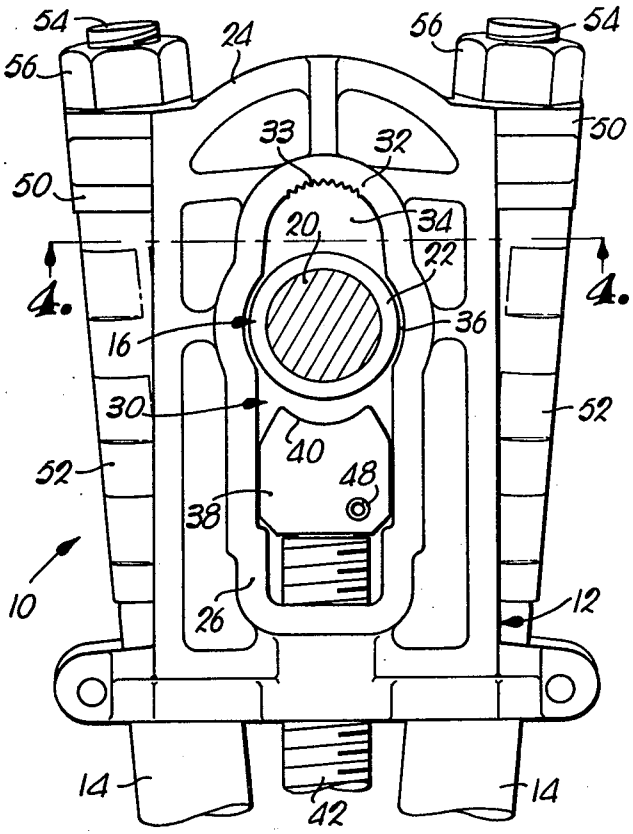
FIG. 3 is an elevational view showing the side of the clamp opposite to that illustrated in FIG. 1 and further showing the grounding stud in cross-section.
Figure 4:
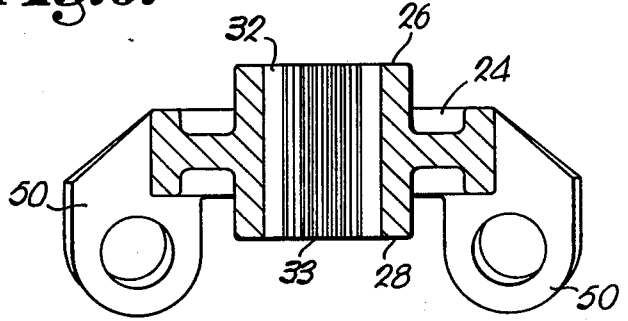
FIG. 4 is a cross-sectional view taken along line 4—4 of FIG. 3.

As shown in FIGS. 1 and 3, the transverse cross-section of the passage 30 presents a generally U-shaped bight 32 configured to complementally receive the shank 20 of stud 16 in a manner to be described. A plurality of serrations 33 are provided along a section of bight 32 for positive gripping of the shank 20.

It is important to note that the body 24 completely circumscribes the passage 30 such that the latter presents a trasnverse cross-section having a continuous periphery. By virtue of this unique construction, the bight 32 is rendered virtually nondeformable and consequently maintains its grip on the stud 16 even under high fault current conditions.

Further considering FIGS. 1 and 3, it can be seen that a portion of the cross-section of the passage 30 has a keyhole-shape including a neck zone 34 defined by the bight 32 and a wider head zone 36 opening into the neck zone 34. As shown particularly in FIG. 3, the head zone 36 is of a dimension sufficient to permit passage of shoulder 22 therethrough whereas the neck zone 34 is configured to preclude entrance of the shoulder 22.

A gripper block 38 is slidably disposed within the passage 30 for movement toward and away from the bight 32. The block 38 is provided with an arcuate surface 40 normally facing the bight 32 and having a curvature opposite to that of the latter such that there is cooperably formed a substantially cylindrical gripping structure when block 38 is disposed adjacent the bight 32. Sliding movement of the block 38 is effected by an eye bolt 42 threadably coupled with the body 24 in such a manner that it projects into the passage 30 with its screw axis extending perpendicularly of the bight 32. A grooved boss 44 on one end of bolt 42 is captively retained within a recess 46 in the block 38 by a split tubular spring pin 48 such that the block moves toward and away from the bight 32 in response to screwing movement of the bolt 42.

The clamp 12 further comprises a pair of mounting lugs in the form of cable-engaging apertured bosses 50 disposed on opposite sides of the passage 30 proximal to the bight 32. Each cable 14 is provided with a ferrule 52 for mounting a threaded end terminal 54 on the cable 14. Each terminal 54 is attached to a respective boss 50 by engagement with a threaded nut 56 such that the cables 14 are securely mounted on the body 24. To augment the mounting of the cables 14, each of the latter is provided with a second mounting lug, spaced from the first mounting lug, in the form of a clamping strap 58 releasably secured to the body 24 by a pair of machine screws 60 disposed on opposite sides of the cable 14. In this manner, each cable 14 is secured to the body 24 at two separate locations such that there is resistance to mechanical damage caused by whipping of the cables 14 induced by high electromagnetic forces experienced when high fault currents are conducted to the assembly 10.

In use, the stud 16 is intended to be permanently affixed to the electrical device desired to be grounded. Typically, the stud 16 would be bolted to the device and it is contemplated that base 18 be provided with a universal bolt hole pattern to be compatible with existing mounting holes in standard electrical devices. An alternate means of attaching stud 16 to structures is by welding.

To deenergize electrical apparatus equipped with stud 16, the lineman or maintainer operates the screw 42 to slide the block 38 to its farthest removed position from the bight 32. He next secures the clamp 12 to his hot line tool and manipulates the body 24 to position the stud 16 within the passage 30. In this connection, the body 24 must first be oriented such that the shoulder 22 is aligned with the head zone 36 thereby permitting the shoulder 22 to be inserted through the passage 30. When the body 24 is positioned on shank 20 between the plate 18 and the shoulder 22, the clamp 12 may be shifted so that the shank 20 is received within the neck zone 34. It will be appreciated that with the clamp 12 so disposed, it cannot be removed from the stud 16 unless shank 20 is first displaced from the neck section 32 to the head section 30.

Figure 2:
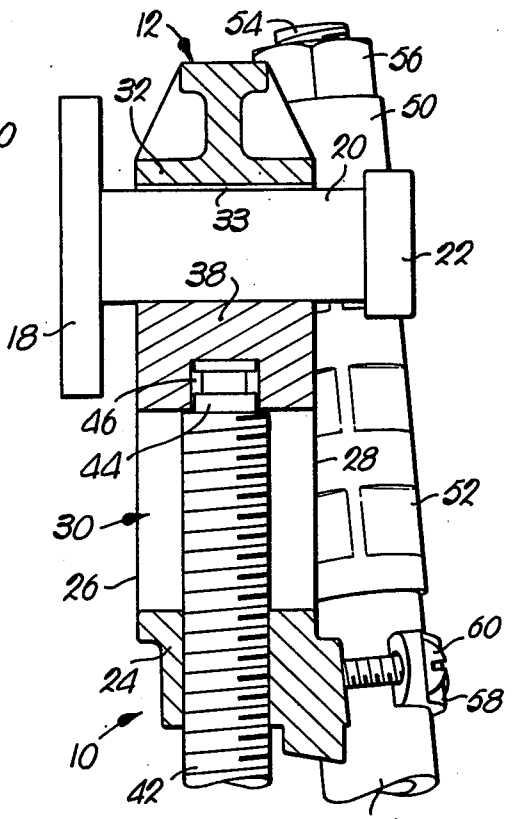
FIG. 2 is a cross-sectional view taken along line 2—2 of FIG. 1.

The lineman then operates bolt 42 with a hot stick to move the block 38 toward bight 32 until surface 40 engages the shank 20 and clamps the latter against the bight 32 as shown in FIGS. 1 and 2. Further tightening of the bolt 42 securely seats the shank 20 within the cylindrical clamping structure defined by surface 40 and bight 32, such that an extremely good electrical and mechanical connection is established between the clamp 12 and the stud 16. Note particularly that the serrations 33 serve to bite into the shank 20 for the purpose of establishing good electrical contact and preventing rotation of the clamp 12 relative to the stud 16.

Should a fault be encountered while the lineman is working on the deenergized electrical device, the fault current will be conducted safely and relatively harmlessly to ground. Similarly, should the device be accidentally energized, the short circuit established by the ground will cause actuation of a circuit breaker in the line, thereby avoiding serious injury to the worker.

Once maintenance procedures have been completed, the lineman simply operates bolt 42 to position the block 38 as shown in FIG. 3, manipulates the clamp 12 such that stud 16 is disposed within head zone 36, and then moves the clamp axially of the stud 16 thereby disconnecting the ground circuit from the electrical device.

The principles of the present invention permit the construction of a lightweight, relatively inexpensive grounding clamp capable of safely conducting currents in the order of 100,000 amps or more. The closed construction of passage 30 with body 24 in circumscribing relation thereto provides maximum resistance to deflection in the critical area of bight 32.

Moreover, the novel keyhole cross-section of the passage 30 further assures positive contact between the grounding stud 16 and the clamp 12. By virtue of the keyhole arrangement, body 24 is captured between plate 28 and shoulder 22 when the shank 20 is disposed within the neck zone 34. Thus, the keyhole construction cooperates with the sliding block 38 to effect the desired positive coupling between clamp 12 and stud 16.

A further advantage offered by the grounding clamp assembly 10 is that the electrical apparatus being grounded is not marred or otherwise damaged by the clamp 12. This is for the reason that the mechanical clamping force is exerted only on the stud 16, there being no direct contact between the clamp 12 and the apparatus itself or bus interconnection.

While the advantages of the present invention have been discussed in terms of high fault current application, it is also contemplated that the clamp assembly 10 could be used effectively in low fault current applications as well. In this connection, by virtue of the unique shape of body 24, a clamp 12 may be made much more compact than a similarly rated conventional grounding clamp. Thus, the present invention is well suited for use in close quarters as, for example, metal clad switchgear. Similar advantages are realized when the invention is used as a hot line clamp.

Having thus described the invention, what is claimed as new and desired to be secured by Letters Patent is:

1. A grounding clamp assembly for releasably coupling a ground cable with an electrical device in environments where high fault currents may be experienced, said assembly including:

a rigid, generally annular body defining a central, open-ended passage;

means attaching said cable to the body;

a male member adapted to be mounted on said device in outwardly projecting relation thereto, said passage including a bight adapted to receive and grippingly engage said member; and means for selectively biasing the member against said bight to form a secure connection between said body and the member, said body fully circumscribing said passage, the latter having a transverse cross-section presenting a continuous periphery for resisting distortion of the member-engaging bight when high fault currents are conducted to the assembly, the cross-section of said passage including a keyhole-shaped portion having a head zone and neck zone of smaller cross-sectional area than said head zone, said bight forming a part of said neck zone, said member including a shank configured to be received within said neck zone and an enlarged shoulder on one end of said shank for locking said body onto said shank when the latter is disposed within the neck zone.

2. The invention of claim 1, said bight being serrated for position gripping said shank.

3. The invention of claim 2, said shank being cylindrical, said neck section having a complemental U-shaped configuration.

* * * * *